US006467499B1

(12) United States Patent
Smith

(10) Patent No.: US 6,467,499 B1
(45) Date of Patent: Oct. 22, 2002

(54) REEL AND HOSE COVERING DEVICE

(76) Inventor: Macey Smith, 3207 Pioneer Ct., Joliet, IL (US) 60431

( * ) Notice: Subject to any disclaimer, the term of this patent is extended or adjusted under 35 U.S.C. 154(b) by 0 days.

(21) Appl. No.: 09/933,401

(22) Filed: Aug. 20, 2001

(51) Int. Cl.[7] ..... F16K 27/12

(52) U.S. Cl. ..... 137/355.16; 137/355.26; 137/377

(58) Field of Search ..... 137/355.26, 355.16, 137/377

(56) References Cited

U.S. PATENT DOCUMENTS 2,696,406 A * 12/1954 Myers ..... 137/355.16
3,776,262 A * 12/1973 Fritsch ..... 137/355.16
4,006,948 A * 2/1977 Kessinger ..... 137/355.16 X
5,678,596 A * 10/1997 Corallo ..... 137/355.16 X
5,678,599 A * 10/1997 Moss ..... 137/377
6,050,291 A * 4/2000 Whitehead et al. .... 137/355.26
6,306,221 B1 * 10/2001 Magliocca ..... 134/10

* cited by examiner

*Primary Examiner*—Kevin Lee

(57) ABSTRACT

A reel and hose covering device including a cover member dimensioned for receiving a reel and hose interiorly thereof. The cover member has a generally cylindrical configuration defined by a substantially closed front wall, an open back, and a cylindrical side wall therebetween. The cylindrical side wall is couplable with a selected wall area adjacent to the reel by a piano hinge whereby the cover member can be closed with the reel received within the open back. The cylindrical side wall has a metal strip secured thereto diametrically opposed from the piano hinge. The front A wall has an opening therethrough to allow passage of the hose therethrough. A magnet is secured to the selected wall area adjacent to the reel opposed from the piano hinge. The magnet engages the metal strip of the cover member in a closed orientation.

2 Claims, 2 Drawing Sheets

REEL AND HOSE COVERING DEVICE

BACKGROUND OF THE INVENTION

The present invention relates to a reel and hose covering device and more particularly pertains to concealing and protecting a reel and hose.

The use of storage devices is known in the prior art. More specifically, storage devices heretofore devised and utilized for the purpose of providing storage are known to consist basically of familiar, expected and obvious structural configurations, notwithstanding the myriad of designs encompassed by the crowded prior art that have been developed for the fulfillment of countless objectives and requirements.

By way of example, U.S. Pat. No. 3,778,262 to Fritsch discloses a cylindrical enclosure for storing a coiled garden hose. U.S. Pat. No. 4,330,005 to Kjarsgaard discloses a hose reel storage device. U.S. Pat. No. 5,390,695 to Howard discloses a hose reel storage device.

While these devices fulfill their respective, particular objective and requirements, the aforementioned patents do not describe a reel and hose covering device for concealing and protecting a reel and hose.

In this respect, the reel and hose covering device according to the present invention substantially departs from the conventional concepts and designs of the prior art, and in doing so provides an apparatus primarily developed for the purpose of concealing and protecting a reel and hose.

Therefore, it can be appreciated that there exists a continuing need for a new and improved reel and hose covering device that can be used for concealing and protecting a reel and hose. In this regard, the present invention substantially fulfills this need.

SUMMARY OF THE INVENTION

In the view of the foregoing disadvantages inherent in the known types of storage devices now present in the prior art, the present invention provides an improved reel and hose covering device. As such, the general purpose of the present invention, which will be described subsequently in greater detail, is to provide a new and improved reel and hose covering device that has all the advantages of the prior art and none of the disadvantages.

To attain this, the present invention essentially comprises a reel securable to a selected wall area. A hose is wrappedly disposed around the reel. The hose has a water inlet and a water outlet. The water inlet is couplable with a water source. A cover member is dimensioned for receiving the reel and hose interiorly thereof. The cover member has a generally cylindrical configuration defined by a closed front wall, an open back, and a cylindrical side wall therebetween. The cylindrical side wall is coupled with the selected wall area adjacent to the reel by a piano hinge whereby the cover member can be closed with the reel received within the open back. The cylindrical side wall has a metal strip secured thereto diametrically opposed from the piano hinge. The front wall has an opening therethrough to allow passage of the water outlet of the hose therethrough. A magnet is secured to the selected wall area adjacent to the reel opposed from the piano hinge. The magnet engages the metal strip of the cover member in a closed orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reel and hose covering device that has all the advantages of the prior art storage devices and none of the disadvantages.

It is another object of the present invention to provide a new and improved reel and hose covering device that may be easily and efficiently manufactured and marketed.

It is a further object of the present invention to provide a new and improved reel and hose covering device that is of durable and reliable construction.

An even further object of the present invention is to provide a new and improved reel and hose covering device that is susceptible of a low cost of manufacture with regard to both materials and labor, and which accordingly is then susceptible of low prices of sale to the consuming public, thereby making such a reel and hose covering device economically available to the buying public.

Even still another object of the present invention is to provide a new and improved reel and hose covering device for concealing and protecting a reel and hose.

Lastly, it is an object of the present invention to provide a new and improved reel and hose covering device including a cover member dimensioned for receiving a reel and hose interiorly thereof. The cover member has a generally cylindrical configuration defined by a closed front wall, an open back, and a cylindrical side wall therebetween. The cylindrical side wall is couplable with a selected wall area adjacent to the reel by a piano hinge whereby the cover member can be closed with the reel received within the open back. The cylindrical side wall has a metal strip secured thereto diametrically opposed from the piano hinge. The front wall has an opening therethrough to allow passage of the hose therethrough. A magnet is secured to the selected wall area adjacent to the reel opposed from the piano hinge. The magnet engages the metal strip of the cover member in a closed orientation.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
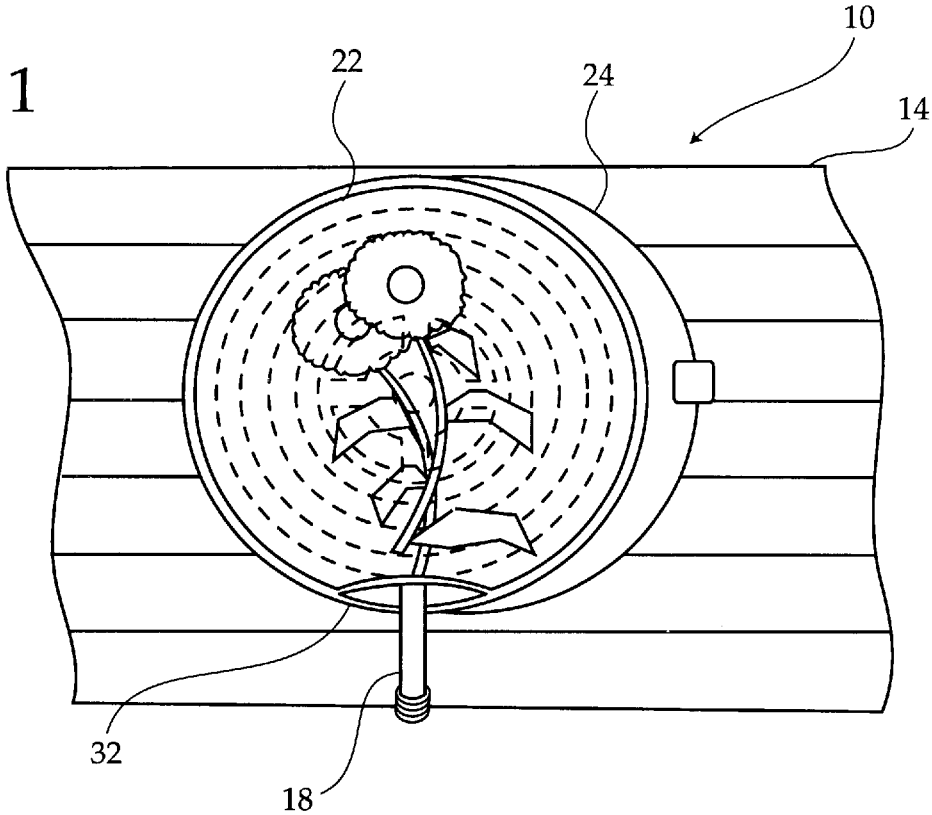
FIG. 1 is a perspective view of the preferred embodiment of the reel and hose covering device constructed in accordance with the principles of the present invention.

With reference now to the drawings, and in particular, to figures one through four thereof, the preferred embodiment of the new and improved reel and hose covering device embodying the principles and concepts of the present invention and generally designated by the reference number 10 will be described.

Specifically, it will be noted in the various figures that the device relates to a reel and hose covering device for concealing and protecting a reel and hose. In its broadest context, the device consists of a reel, a hose, a cover member, and a magnet. Such components are individually configured and correlated with respect to each other so as to attain the desired objective.

The reel 12 is securable to a selected wall area 14. The reel 12 is circular in configuration, similar to those found in the art.

The hose 16 is wrappedly disposed around the reel 12. The hose 16 has a water inlet and a water outlet 18. The water inlet is couplable with a water source, typically an outdoors water spigot. The water outlet 18 is adapted for coupling with a standard water nozzle or the like.

The cover member 20 is dimensioned for receiving the reel 12 and hose 16 interiorly thereof. The cover member 20 has a generally cylindrical configuration defined by a substantially closed front wall 22, an open back 24, and a cylindrical side wall 26 therebetween.

The cylindrical side wall 26 is coupled with the selected wall area 14 adjacent to the reel 12 by a piano hinge 28 whereby the cover member 20 can be closed with the reel 12 received within the open back 24. The cylindrical side wall 26 has a metal strip 30 secured thereto diametrically opposed from the piano hinge 28. The front wall 22 has an opening 32 therethrough to allow passage of the water outlet 18 of the hose 16 therethrough.

The magnet 36 is secured to the selected wall area 14 adjacent to the reel 12 opposed from the piano hinge 28. The magnet 36 engages the metal strip 30 of the cover member 20 in a closed orientation.

Figure 2:
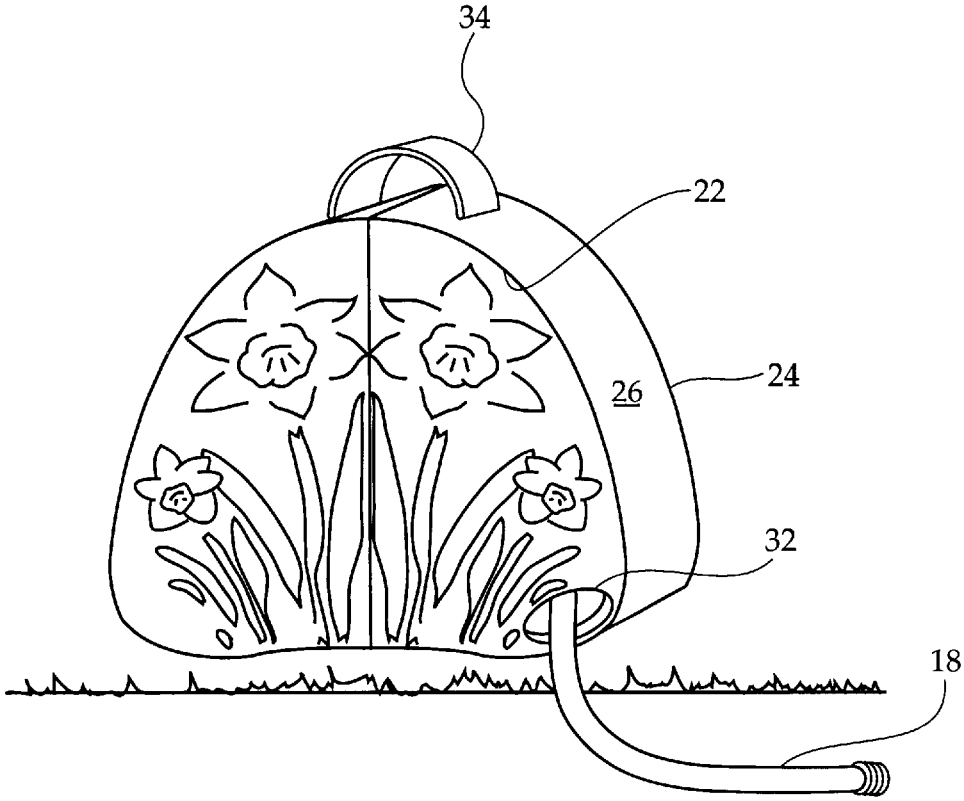
FIG. 2 is a front view of present invention illustrating in a detached mode.
Figure 3:
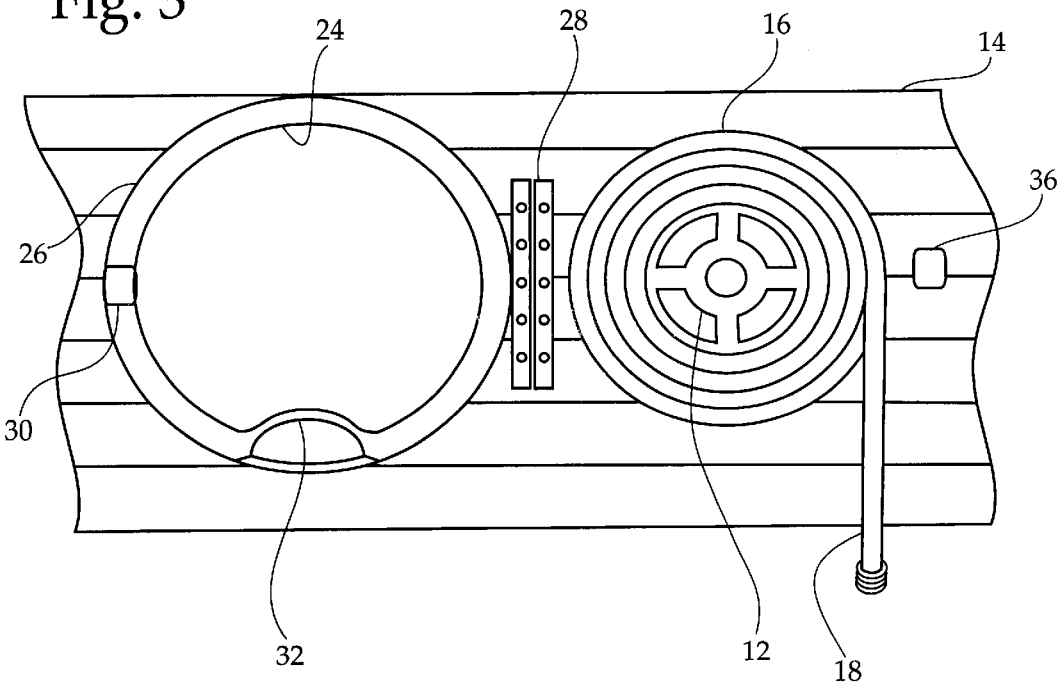
FIG. 3 is a front view of the present invention illustrated in an open orientation.

In a second embodiment, as shown in FIG. 2, the cover member 20 can be provided with a handle 34 that is secured to the cylindrical side wall 26 to allow for easy handling. The cover member 20 can be positioned over a reel 12 and hose 18 that is sitting on a ground area. The handle 34 can be used to lift the cover member 20 to expose the reel 12 and hose 18 for use. Additionally, the cover member 20 is essentially triangular in age shape with rounded edges.

Figure 4:
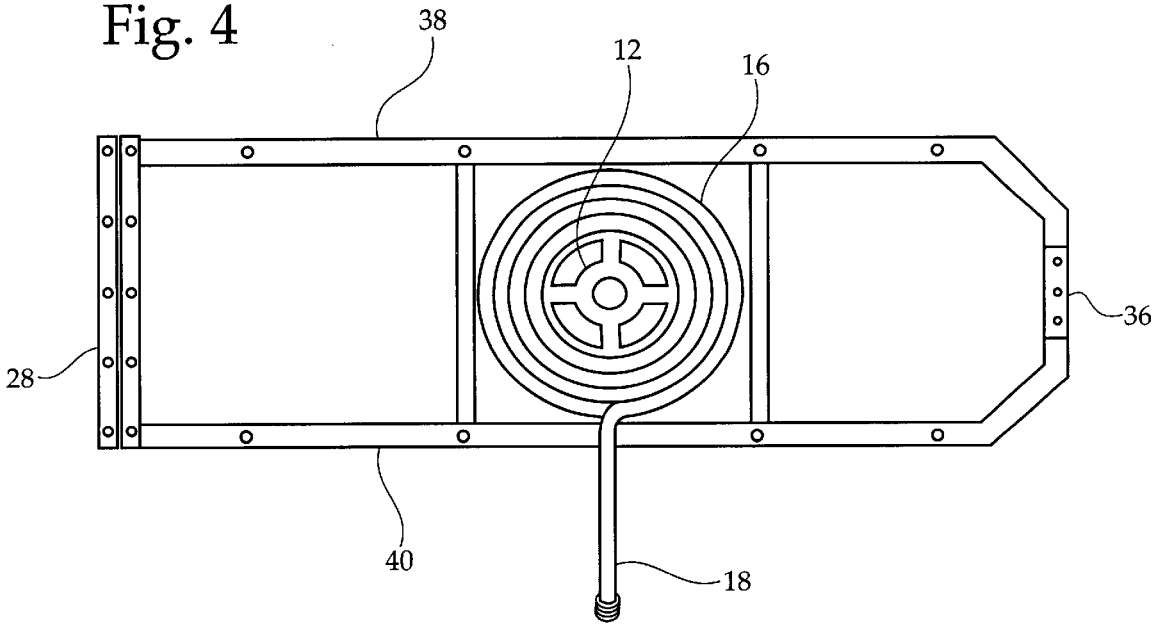
FIG. 4 is a front view of an alternate embodiment of the present invention.

A third embodiment of the present invention is shown in FIG. 4 and includes substantially all of the components of the present invention wherein the cover member 20 is enlarged to accommodate a larger reel 12. The cover member 20 is also provided with elongated upper and lower braces 38,40 to support the cover member 20 as it is opened and closed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reel and hose covering device for concealing and protecting a reel and hose comprising, in combination:

a reel securable to a selected wall area;

a hose wrappedly disposed around the reel, the hose having a water inlet and a water outlet, the water inlet being couplable with a water source;

a cover member dimensioned for receiving the reel and hose interiorly thereof, the cover member having a generally cylindrical configuration defined by a closed subtantially front wall, an open back, and a cylindrical side wall therebetween, the cylindrical side wall being coupled with the selected wall area adjacent to the reel by a piano hinge whereby the cover member can be closed with the reel received within the open back, the cylindrical side wall having a metal strip secured thereto diametrically opposed from the piano hinge, the front wall having an opening therethrough to allow passage of the water outlet of the hose therethrough; and a magnet secured to the selected wall area adjacent to the reel opposed from the piano hinge, the magnet engaging the metal strip of the cover member in a closed orientation.

2. A reel and hose covering device for concealing and protecting a reel and hose comprising, in combination:

a cover member dimensioned for receiving a reel and hose interiorly thereof, the cover member having a generally cylindrical configuration defined by a closed substantially front wall, an open back, and a cylindrical side wall therebetween, the cylindrical side wall being couplable with a selected wall area adjacent to the reel by a piano hinge whereby the cover member can be closed with the reel received within the open back, the cylindrical side wall having a metal strip secured thereto diametrically opposed from the piano hinge, the front wall having an opening therethrough to allow passage of the hose therethrough; and a magnet secured to the selected wall area adjacent to the reel opposed from the piano hinge, the magnet engaging the metal strip of the cover member in a closed orientation.

* * * * *